US010368653B2

(12) United States Patent
Plouffe et al.

(10) Patent No.: US 10,368,653 B2
(45) Date of Patent: Aug. 6, 2019

(54) SPACE SAVING SECURE STORAGE DEVICE

(71) Applicants: Guy Plouffe, Poway, CA (US); Darla Reed, Poway, CA (US)

(72) Inventors: Guy Plouffe, Poway, CA (US); Darla Reed, Poway, CA (US)

( * ) Notice: Subject to any disclaimer, the term of this patent is extended or adjusted under 35 U.S.C. 154(b) by 67 days.

(21) Appl. No.: 15/247,855

(22) Filed: Aug. 25, 2016

(65) Prior Publication Data

US 2017/0164756 A1 Jun. 15, 2017

Related U.S. Application Data

(60) Provisional application No. 62/265,946, filed on Dec. 10, 2015.

(51) Int. Cl.
*A47C 21/00* (2006.01)
*A47B 79/00* (2006.01)

(52) U.S. Cl.
CPC ..... *A47C 21/00* (2013.01); *A47B 79/00* (2013.01)

(58) Field of Classification Search
CPC ..... A47C 21/00
USPC ..... 5/503.1, 53.1–53.3, 658
See application file for complete search history.

(56) References Cited

U.S. PATENT DOCUMENTS 3,351,960 A * 11/1967 Burkholder ..... A47C 19/022 5/503.1
2013/0305459 A1* 11/2013 Kaiser ..... A47C 19/022 5/658

* cited by examiner

*Primary Examiner* — Fredrick C Conley

(57) ABSTRACT

A storage device for providing storage space for personal items such as notebook computers, cell phones, cash and anything of value that a user wishes to keep safe. The storage device includes a container structure having a door portion pivotally mounted so as to rotate from a closed, vertical position to an open, horizontal position and a leg element having a first portion attached to the container structure and a second portion oriented at generally right angles to the first leg portion. In use, the storage device of the present invention is mounted over the foot of a bed by the leg portions that are not attached to the container structure so as to extend under the mattress. In this manner the storage device affords a storage space without detracting from available floor space and without wall mounting. The top of the storage device of the present invention can serve as a night stand given its proximity to the bed, again without necessitating reduction is overall available floor space. The door of the storage device of the present invention can also act as a convenient work space when in an open position.

17 Claims, 5 Drawing Sheets

SPACE SAVING SECURE STORAGE DEVICE

BACKGROUND OF THE INVENTION

The present invention pertains to storage devices and, more particularly, to a storage device for venues having limited floor space.

A number of venues abound where floor space is limited. It has been reported, for example, that the average dormitory room at a college or university averages some twelve by nineteen feet, or about 228 square feet. Since most dorm rooms are expected to house two occupants, each student is expected to live in about 114 square feet. Into this space various necessary items must be sited, including a desk for study, personal item storage and a bed. The average size of a single twin bed has been reported as being about 39 inches wide by some 75 inches long, or about 20.3 square feet, and the average dorm room desk has been reported as being about 44 inches long by 22 inches deep or about 6.7 square foot, leaving each student a meager 87 square feet both for storage of personal items, such as clothing and electronic devices, and for living space in an average dorm room. It should be noted that college dorm rooms are not the sole source of cramped venues. Other similar venues of minimal dimensions exist in a number of settings, for example on board various ships such as naval vessels, cargo ships, pleasure craft and the like. Additionally, in other countries around the world numerous settings abound with limited living space. In China for example, factory dormitory living spaces as small as 42 square feet have been reported.

A variety of storage mechanisms abound. Wall mounted devices, however, are often excluded since many colleges and universities do not permit nails or screws to be inserted into the dorm room walls. There is also a diverse plethora of storage devices, such as trunks, steamers and the like, that are not wall mounted. But all of these storage devices suffer from a common deficit. Whatever storage space is provided by the device, the available square footage of the already cramped venue is further reduced by an amount equal to the area taken up by the device on the floor. An average trunk is reported to have dimensions of 16 deep by 30 inches long by 12.5 inches height, for example, thus depriving the user of another 3.33 square feet of floor space. Thus there still exists a need for a storage device that provides storage capacity for a cramped venue without placement upon the already minuscule floor space available and without resorting to usually prohibited wall mountings. The present invention fulfills this need.

BRIEF SUMMARY OF THE INVENTION

The present invention overcomes the deficiencies mentioned above by providing a storage space that does not reduce the amount of available floor space and does not require wall mounting. The present invention further provides a supplemental work space or viewing area and, in one preferred embodiment, further provides a secure storage space for valuable items.

To attain these goals, the present invention generally comprises a container structure having a door portion pivotally mounted so as to rotate from a generally vertically oriented closed position to a generally horizontally oriented open position, and a leg element having a first portion and a second portion oriented generally perpendicular to said first portion, with one portion of the leg element being attached to the container structure. Space saving storage is achieved by mounting the storage device of the present invention over one end of a bed usually occupied by the user's feet. This mounting is effectuated by positioning the unattached portion of the leg element under the mattress of the bed. In one preferred embodiment of the present invention a pair of leg elements are employed. In yet another embodiment of the present invention the storage device further comprises a longitudinally orientable leg element having opposing ends connected to the portions of the leg elements that are unattached to the container structure. In still another embodiment of the present invention a unitary leg structure is employed wherein said leg element includes a first portion and a second portion oriented generally perpendicularly to said first portion, a third portion and a fourth portion oriented generally perpendicularly to said third portion and a fifth portion joining said second and fourth portions with this leg element being attached to the container structure by the first and third portions on the unitary leg structure. In this embodiment of the present invention, the storage device is mounted at one end of a bed by positioning the second, fourth and fifth leg portions under the bed.

In one preferred embodiment of the present invention the container structure further defines a pair of apertures in a bottom portion of the container and the leg elements are attached to the container by positioning the leg elements so that portions thereof project into the container structure through these apertures to abut an inner portion of the container. In a further embodiment of the present invention the container structure includes a door portion pivotally attached to the container structure so as to rotate generally down from a generally vertically oriented closed position to a generally horizontally oriented open position, and wherein an inner surface of said door portion forms a generally horizontal working surface when the door portion is in an open position. In still further embodiments of the present invention a lock is affixed to the container door. In yet a still further embodiment of the present invention the container structure further defines an aperture and the storage device further includes a power strip disposed within the container with a power cord from the strip projecting through the container aperture.

The foregoing, and further advantages, features and principles of the present invention will become more readily apparent from the following detailed description of several preferred embodiments of the present invention that follows below with reference to the accompanying drawings.

DETAILED DESCRIPTION

Figure 1:
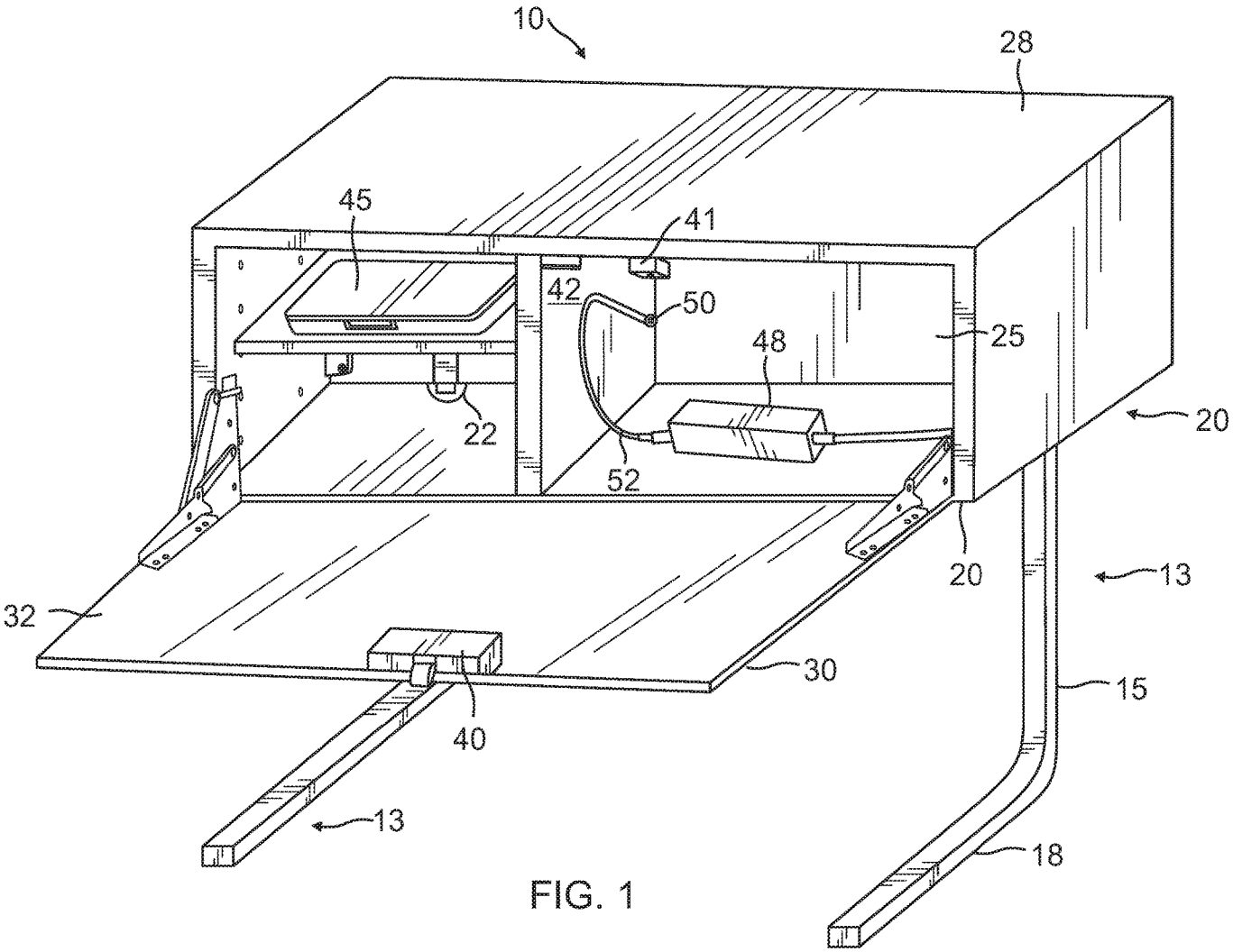
FIG. 1 is a perspective view of the storage device of the present invention according to one preferred embodiment thereof.

Referring to the figures, and more particularly FIG. 1 thereof, there is shown one preferred embodiment of the present invention. As illustrated, the storage device of the present invention includes a container structure 10 attached to leg elements 13. As further illustrated in FIG. 2 the leg elements 13 comprise a first portion 15 and a second portion 18 oriented generally perpendicularly to the first portion 15. In use, and as illustrated in FIG. 3, the storage container of the present invention is mounted at one end of a bed where a user will normally place their feet. This mounting is accomplished by positioning the second portions 18 of the leg elements 13 under a mattress of the bed. Where the user employs both a mattress and a box spring the second portions 18 of the leg elements 13 are positioned between the mattress and this box spring. By mounting the container structure over the foot of the bed, the storage device of the present invention affords additional storage space without detracting from the available floor space of the room, and without mounting the storage device upon a wall.

To effectively site the storage device of the present invention over the foot of a bed without interfering with a user's laying in the bed, the length of the first portions 15 of the leg elements 13 should have a length optimally long enough to accommodate the presence of the user's feet residing in a vertical orientation on the top of the bed without contacting a bottom 20 of the container structure 10. In one preferred embodiment it has been determined that the space between the top of a mattress and the bottom of the container structure should be at least one foot long. The first portion 13 of the leg elements should therefore be long enough to accommodate the average thickness of an average mattress and an additional foot in length. In one preferred embodiment of the present invention, therefore, the first portions 15 of the leg elements 13 projecting out of the bottom 20 of the container structure 10 are at least approximately 18 inches long to accommodate the thickness of average mattress thicknesses in the United States.

In an alternative preferred embodiment of the present invention the first portions 15 of the leg elements 13 project through apertures 22 in the bottom 20 of the container 10 to extend along a back inside surface 25 of the container structure 10 and abut a top element 28 of the container structure 10. This configuration provides stable mounting of the leg elements 13 to the container structure with minimal hardware requirements. In this embodiment the overall length of the first portion 15 of the leg elements 13 would be at least 18 inches longer than the overall internal height of the container structure 10, plus the thickness of the container bottom 20 to accommodate a user's feet under the container structure. Optimally, although not necessarily, in this embodiment of the present invention the first portions 15 of the leg elements 13 are each configured with a bore positioned to reside adjacent an upper surface of the bottom 20 of the container structure 10. The leg elements 13 can then be secured to the container structure by providing and placing a retainer clip through this bore in the first portions 15 of the leg elements 13. The retainer clip precludes removal of the first portions 15 of the leg elements 13 from within the container structure 10.

As further illustrated in FIGS. 1 and 3, the storage device of the present invention further includes a door portion 30 pivotally mounted to the container structure 10 so as to rotate from a generally vertically oriented closed position to a generally horizontally oriented open position. In one preferred embodiment of the present invention the door portion 30 is pivotally attached to the container structure 10 so as to rotate in a downward direction from a generally vertically oriented closed position to a generally horizontally oriented open position. By mounting the door 30 in this fashion an inner surface of said door portion forms a generally horizontal working surface 32 when the door portion is in an open position. This pivotal attachment of the door portion 30 to the container structure 10 may be effectuated in a variety of different ways without departing from the scope of the present invention. For example, pivoting mounting structures 35 may be affixed to inner surfaces of opposing side portions 38 of the container structure 10, proximate the bottom thereof, and affixed to the working surface 32 of the door portion 30. Examples of such pivoting mounting structures include the model number 372.49.700 (right) and 372.49.701 (left) manufactured by Hafele (www.hafele.com). In an alternative embodiment, the door portion 30 may be attached to the container bottom 20 with a hinge structure of any type well known in the hinge art to effectuate the door rotating generally downward from a vertically oriented closed position to a horizontally oriented open position. In this embodiment a sliding rod may be pivotally coupled to the work surface 32 of the door portion 30 and slidingly coupled to a retaining element affixed to the inner surfaces of the opposing side portions 38 of the container structure 10.

In one preferred embodiment of the present invention the door portion 30 is further equipped with a lock mechanism 40 and the top element 28 of the container structure 10 equipped with a latch 41 so that the door can be locked in place when oriented in a closed, generally vertical orientation, thus preventing unauthorized access to the contents of the container structure 10 when the door is closed. The inventor has noted that in typical dormitory settings, for example, two students are assigned to each room and they may have never met until they find themselves living together. In such circumstances neither student can necessarily trust the other has developed a lifetime habit of locking their room whenever it is left unoccupied. The inventor has further noted dormitories are traditionally lively places where an activity spontaneously occurring in the dormitory hallway or common area may lure a student out of their room in circumstances which may cause them to forget to lock their room. Accordingly, the inventor has determined that the addition of a lock mechanism 40 to the storage device of the present invention can very beneficially prevent loss of expensive personal items such as a student's notebook computer or personal electronic devices such as their mobile phone.

Figure 2:
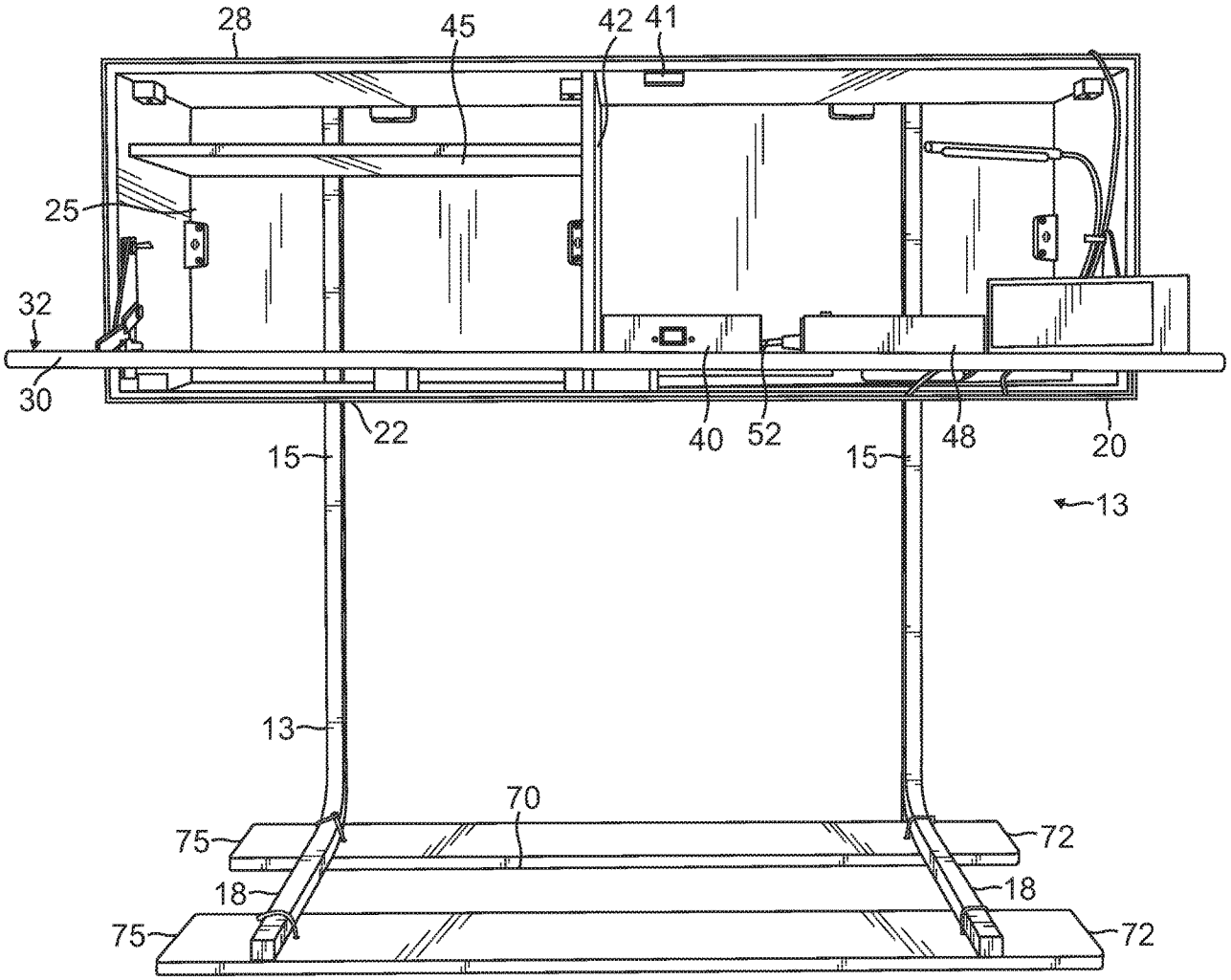
FIG. 2 is a frontal view of the storage device of one preferred embodiment of the present invention.
Figure 3:
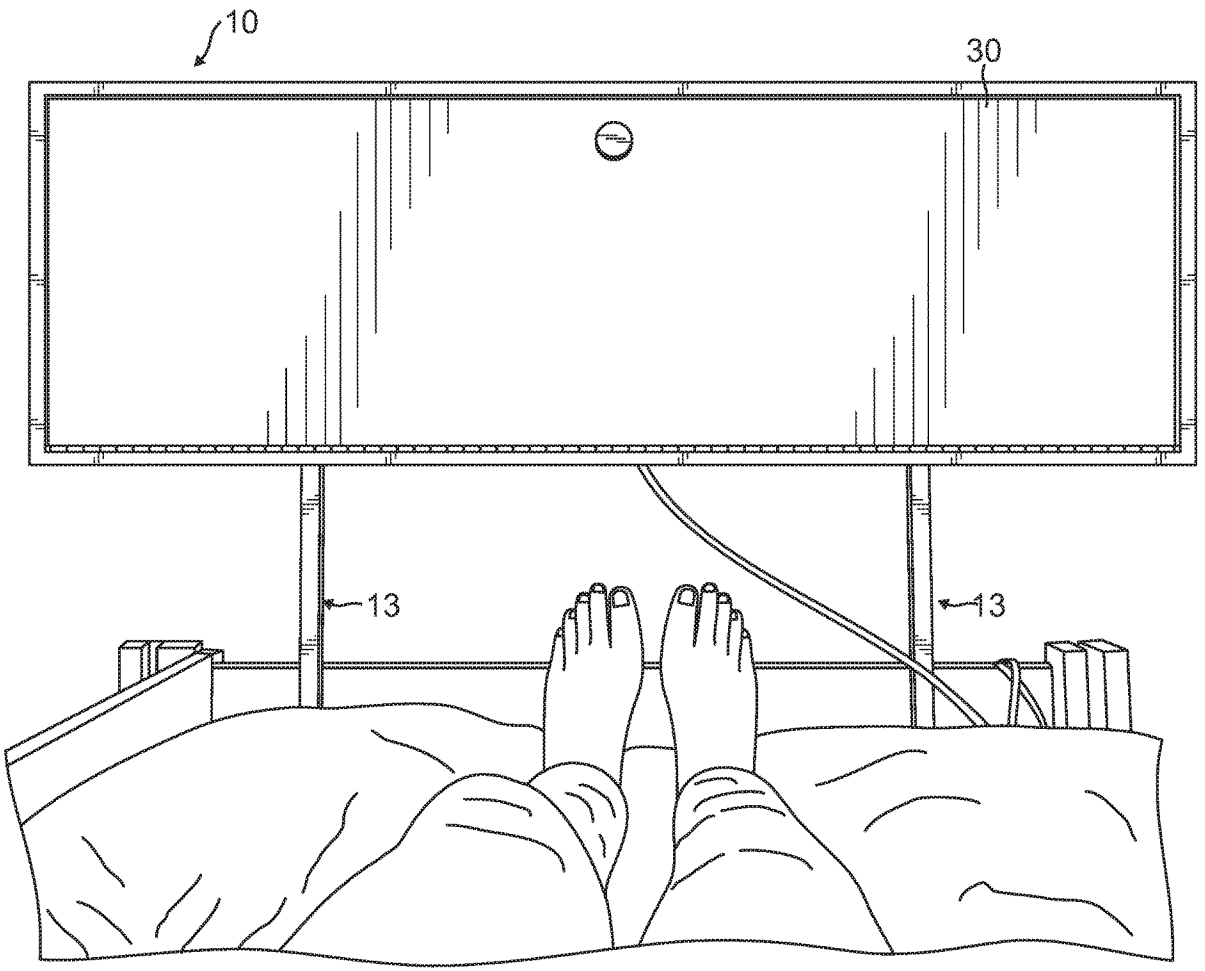
FIG. 3 is a frontal view of the storage device of the present invention mounted over one end of a mattress bed.

As further illustrated in FIGS. 1 and 2 in one embodiment of the present invention the container structure 10 may be supplied with an internal vertical divider 42 and one or more shelves 45 to provide convenient storage spaces for sundry personal items such as a personal notebook type computer. In yet another embodiment of the present invention these shelves 45 may be adjustable. In addition to providing a secure storage space for valuable personal items without diminishing available floor space in a restricted space, a further embodiment of the present invention is equipped with a power strip 48 to accommodate charging of personal electronic devices, such as a notebook computer and cell phone, while such items are securely stored within the container structure 10. The bottom 20 of the container structure may further define a bore 50 therethrough to accommodate a power cable 52 of the power strip 48.

The container structure 10 of the present invention may be composed of a variety of suitable materials without departing from the spirit and scope of the present invention. In one embodiment the container structure if composed of a wooden material such as, for example, plywood. In an alternative embodiment the container structure 10 is composed of a suitable plastic material which may be injection molded. In still another embodiment of the present invention, intended for more secure applications, the container structure 10 may be composed of a metallic material such as sheet metal and the like.

The leg elements 13 of the present invention may similarly be composed of a variety of suitable materials without departing from the spirit and scope of the present invention. In one embodiment of the present invention the leg elements are made of an extruded metal in a cylindrical cross sectional configuration. The entire leg element 13 may be made from a unitary structure and then bent to afford a first portion 15 and a second portion 18 oriented generally perpendicularly to one another. In an alternative embodiment of the present invention the leg elements 13 are made of an extruded metal a generally square cross sectional configuration. Such leg elements 13 can also be made from a unitary structure although a notch will necessarily be cut into the leg elements 13 at the join of the first portion 15 and second portion 18 to accommodate the perpendicular orientation between the first and second portions, 15 and 18, respectively.

Figure 4:
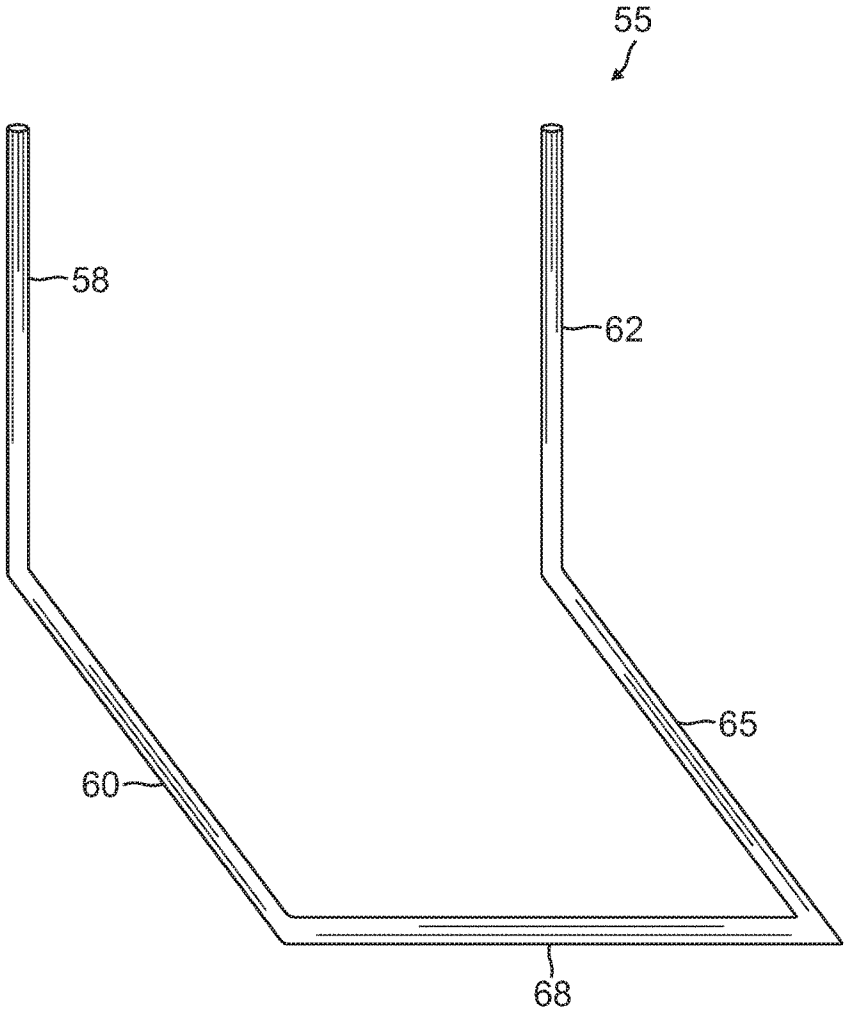
FIG. 4 is a perspective view of an alternative embodiment of the leg elements of the present invention.

In FIG. 4 there is shown an alternative embodiment of the leg structure for use in the present invention. As illustrated in this embodiment the leg element 55 forms a unitary structure including a first portion 58 and a second portion 60 oriented generally perpendicularly to said first portion 58, a third portion 62 and a fourth portion 65 oriented generally perpendicularly to said third portion 62 and a fifth portion 68 joining said second portion 60 and fourth portion 65. In this embodiment the leg element 55 is attached to the container structure 10 by attaching the first portion 58 and the third portion 62 to the container structure. In this embodiment of the present invention the first portion 58 and third portion 62 of the leg element 55 projects through apertures 22 in the bottom 20 of the container 10 to extend along a back inside surface 25 of the container structure 10 and abut a top element 28 of the container structure 10. This configuration provides stable mounting of the leg elements 13 to the container structure with minimal hardware requirements. Referring to FIG. 2, there is illustrated still another embodiment of the present invention wherein one or more longitudinally orientable third leg elements 70 having opposing ends 72 and 75 is or are attached proximate those opposing ends 72 and 75 to the second leg portions 18, unattached to the container structure 10, of leg elements 13.

The present invention affords a secure storage device to store personal items such as, for example, notebook computers, cell phones, cash and anything of value that a user wishes to keep safe. In use, the present invention is mounted over the foot of a bed by legs that extend under the mattress to afford storage space without detracting from available floor space and without wall mounting. The top of the storage device of the present invention can serve as a convenient night stand given its proximity to the bed, again without necessitating reduction is overall available floor space. The door of the storage device of the present invention can also act as a convenient work space.

Figure 5:
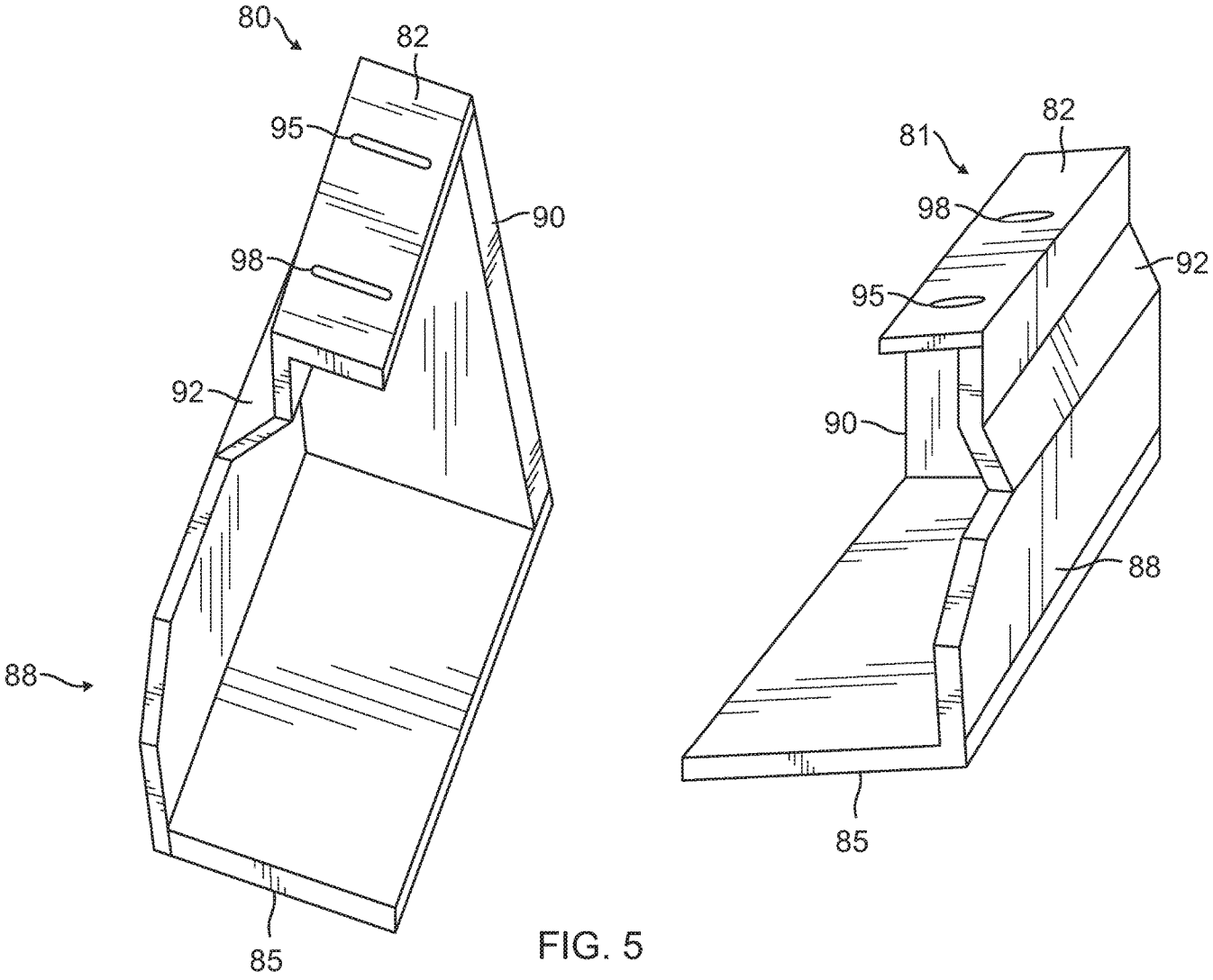
FIG. 5 is a perspective view of yet another alternative embodiment of the leg elements of the present invention.

Referring to FIG. 5 there is shown yet another embodiment of a leg structure of the present invention. As shown, leg elements 80 and 81 are essentially mirror structures of one another, one leg element 80 being intended for attachment to the left side of the container structure 10 and the other leg element 81 being intended for attachment to the right side of the container structure 10. Both leg elements 80 and 81 include an upper segment 82 for attachment to the container bottom 20 and a lower segment 85 intended to be positioned below the mattress and, if box springs are employed, positioned between the box springs and the mattress. Preferably, although not necessarily, the upper segment 82 defines a smaller area than the lower segment 85, thereby allowing the lower segment 85 greater surface area with which to contact or otherwise engage the mattress. The upper and lower segments 82 and 85 are attached to one another with vertical segments 88 and 90 attached to adjacent edges of the upper segment 82 and lower segment 85 so as to be oriented perpendicular to one another. To accommodate the diminished surface area of the upper segment 82 the vertical segment also includes an angled portion 92 extending from one edge of the bottom segment 82 to which vertical segment 88 is attached to an opposing edge of the bottom segment 82. Both leg elements further include a pair of slots 95 and 98 to accept bolts attached to the container bottom 20 so as to firmly attach the leg elements 80 and 81 to the container structure 10.

Having described and illustrated the present invention in various preferred embodiments, it should be readily apparent to those skilled in the relevant arts that the present invention can be modified in arrangement and detail to provide numerous other embodiments that do not depart from the spirit and scope of this invention. Accordingly, all equivalent relationships to those illustrated in the drawings and described in the specification above are intended to be encompassed within the scope of the present invention, as set forth in the claims below and equivalents thereof.

It is to be further understood that the phraseology and terminology employed herein are for the purposes of description only and should not be regarded as limiting the scope of the present invention. Therefore, the foregoing description of the present invention is to be considered as illustrative only of the principles of the present invention. Further, since numerous modifications, changes and alternative embodiments will occur to those skilled in the art, the present invention is not to be limited to the structures, elements, construction and operation shown and described above, but solely by the claims set forth below and equivalents thereof.

What is claimed is:

1. A storage device, comprising:

a container structure having a door portion pivotally mounted so as to rotate from a generally vertically oriented closed position to a generally horizontally oriented open position, said container structure further defining an aperture;

a power strip disposed within the container structure, said power strip having a cord projecting through said container aperture; and a leg element having a first portion and a second portion oriented generally perpendicular to said first portion, said leg element having one portion thereof attached to the container structure, said storage device mounted at one end of a bed by positioning an unattached portion of said leg element under the bed.

2. The storage device of claim 1 wherein said leg element includes a first portion and a second portion oriented generally perpendicularly to said first portion, a third portion and a fourth portion oriented generally perpendicularly to said third portion and a fifth portion joining said second and fourth portions, said leg element further attached to the container structure by said first and third portions, wherein said storage device is mounted at one end of a bed by positioning said second, fourth and fifth leg portions under the bed.

3. The storage device of claim 1 further comprising a second leg element having a first portion and a second portion oriented generally perpendicular to said first portion, both of said leg elements having one portion attached to the container structure, wherein said storage device is mounted at one end of a bed by positioning a portion of both said leg elements under the bed.

4. The storage device of claim 3 further comprising a longitudinally orientable third leg element having opposing ends connected to the portions of the leg elements unattached to the container structure.

5. The storage device of claim 3 wherein said container structure further defines a pair of apertures in a bottom portion of said container structure and wherein a portion of each leg element projects into the container structure through said apertures and abuts an inner portion of the container structure to effectuate attaching the leg elements to the container structure.

6. The storage device of claim 1 wherein said door portion is pivotally attached the container structure so as to rotate generally down from a generally vertically oriented closed position to a generally horizontally oriented open position, and wherein an inner surface of said door portion forms a generally horizontal working surface when said door portion is in an open position.

7. The storage device of claim 6 further compromising a lock affixed to the container door so as to preclude opening of the container structure when said lock is in a locked state.

8. A storage device, comprising:

a container structure having a forward facing door portion pivotally mounted to said container so as to rotate from a generally vertically oriented closed position to a generally horizontally oriented open position, said container structure further defining a pair of apertures in a bottom portion of said container structure; and a first and a second leg element each having a first portion and a second portion oriented generally perpendicular to said first portions, said first and second leg elements each having one portion thereof projecting into the container structure through said apertures and abutting an inner portion of the container structure to effectuate attaching the leg elements to the container structure, wherein said storage device is mounted at one end of a bed by positioning unattached portions of the leg elements under the bed.

9. The storage device of claim 8 wherein the container structure defines an aperture and said storage device further includes a power strip disposed within the container structure, said power strip having a cord projecting through said container aperture.

10. The storage device of claim 8 further comprising a longitudinally orientable third leg element having opposing ends connected to the portions of the leg elements unattached to the container structure.

11. The storage device of claim 8 wherein said door portion is pivotally attached to the container structure so as to rotate generally down from a generally vertically oriented closed position to a generally horizontally oriented open position, and wherein an inner surface of said door portion forms a generally horizontal working surface when said door portion is in an open position.

12. The storage device of claim 11 further compromising a lock affixed to the container door so as to preclude opening of the container structure when said lock is in a locked state.

13. A space saving storage device, comprising:

a rectangular container structure including a top element, a bottom element defining a pair of apertures therethrough, a back element attached along one side thereof to said top element and attached along an opposing side thereof to said bottom element, and at least two side elements respectively attached to opposing ends of the top element and the bottom element so as to form an open container structure, a door element pivotally rotatably mounted to the container and so as to rotate from a vertically oriented closed position, with access to an interior of said open container structure blocked, to a horizontally oriented open position, with access to the interior of said open container structure unobscured, an inner surface of said door element forming a horizontal work surface when said door element is in a horizontally oriented open position, and a pair of leg elements each having a first portion and a second portion forming generally perpendicular angles therebetween, said legs respectively projecting through said apertures in the container bottom element, wherein the container is mounted at a foot of a bed by placement of the second portions of said legs under a mattress.

14. The storage device of claim 13 wherein said door portion is pivotally attached to the container structure so as to rotate generally down from a generally vertically oriented closed position to a generally horizontally oriented open position, wherein an inner surface of said door portion forms a generally horizontal working surface when said door portion is in an open position.

15. The storage device of claim 14 further compromising a lock affixed to the container door so as to preclude opening of the container structure when said lock is in a locked state.

16. The storage device of claim 13 further comprising a longitudinally orientable third leg element having opposing ends connected to the portions of the leg elements unattached to the container structure.

17. The storage device of claim 13 wherein the container structure defines an aperture and said storage device further includes a power strip disposed within the container structure, said power strip having a cord projecting through said container aperture.

* * * * *